US009335677B2

(12) United States Patent
Ogata et al.

(10) Patent No.: US 9,335,677 B2
(45) Date of Patent: May 10, 2016

(54) FIXING APPARATUS FOR FIXING IMAGES FORMED ON SHEET AND IMAGE FORMING APPARATUS PROVIDED WITH THIS FIXING APPARATUS

(71) Applicant: KONICA MINOLTA, INC., Chiyoda-ku, Tokyo (JP)

(72) Inventors: Satoshi Ogata, Hachioji (JP); Takeshi Tamada, Toyohashi (JP); Kenji Izumiya, Hachioji (JP); Hiroshi Oyama, Hino (JP); Masayuki Watanabe, Fuchu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/477,745

(22) Filed: Sep. 4, 2014

(65) Prior Publication Data

US 2015/0063851 A1 Mar. 5, 2015

(30) Foreign Application Priority Data

Sep. 5, 2013 (JP) ..... 2013-183646

(51) Int. Cl.
*G03G 21/00* (2006.01)
*G03G 15/20* (2006.01)

(52) U.S. Cl.
CPC .... *G03G 15/2017* (2013.01); *G03G 2215/2045* (2013.01)

(58) Field of Classification Search
CPC ..... G03G 15/2053; G03G 15/2017; G03G 15/5008; G03G 15/6573; G03G 2215/00156
USPC ..... 399/67–70
See application file for complete search history.

(56) References Cited

U.S. PATENT DOCUMENTS 5,359,401 A 10/1994 Uehara et al.
5,519,475 A 5/1996 Miyamoto et al.
(Continued)

FOREIGN PATENT DOCUMENTS

JP 01074572 A 3/1989
JP 06250560 A 9/1994
(Continued)

OTHER PUBLICATIONS

Extended European Search Report dated Feb. 25, 2015, issued in counterpart European Application No. 14183396.2.
(Continued)

*Primary Examiner* — Walter L Lindsay, Jr.
*Assistant Examiner* — Jessica L Eley
(74) *Attorney, Agent, or Firm* — Holtz, Holtz & Volek PC

(57) ABSTRACT

A fixing apparatus comprises a fixing nip width adjustment unit configured to adjust the fixing nip width of a fixing nip portion; a braking force generation motor configured to generate an effective braking force in the direction to hinder rotation of an upper pressure roller; and a control unit configured to perform restore control for rotating the upper pressure roller and a lower pressure roller by driving a drive motor and speed keeping control for keeping the rotational speed of the braking force generation motor no higher than a predetermined speed during the restore control in a non-fixing period in which the fixing nip width adjustment unit is controlled to decrease the fixing nip width smaller than in a fixing period and a braking force is applied to the fixing side member by the braking force generation motor.

7 Claims, 9 Drawing Sheets

(56) References Cited

U.S. PATENT DOCUMENTS

| | | | | |
|---|---|---|---|---|
| 8,917,999 | B2 | 12/2014 | Takada et al. | |
| 2002/0114642 | A1 | 8/2002 | Rimai et al. | |
| 2004/0247333 | A1* | 12/2004 | Takahashi | 399/68 |
| 2008/0013991 | A1 | 1/2008 | Amico et al. | |
| 2010/0266304 | A1* | 10/2010 | Inoue et al. | 399/68 |
| 2013/0164015 | A1* | 6/2013 | Kawai et al. | 399/69 |
| 2014/0363185 | A1* | 12/2014 | Tamada | G03G 15/2064 399/68 |

FOREIGN PATENT DOCUMENTS

| | | | |
|---|---|---|---|
| JP | 09138598 | A | 5/1997 |
| JP | 2006267198 | A | 10/2006 |
| JP | 2011085636 | A | 4/2011 |
| JP | 2012098458 | A | 5/2012 |
| JP | 2013054108 | A | 3/2013 |
| JP | 2013092680 | A | 5/2013 |

OTHER PUBLICATIONS

Japanese Office Action (and English translation thereof) dated Sep. 1, 2015, issued in counterpart Japanese Application No. 2013-183646.

Japanese Office Action (and English translation thereof) dated Mar. 8, 2016, issued in counterpart Japanese Application No. 2013-183646.

* cited by examiner

FIXING APPARATUS FOR FIXING IMAGES FORMED ON SHEET AND IMAGE FORMING APPARATUS PROVIDED WITH THIS FIXING APPARATUS

CROSS-REFERENCE TO RELATED APPLICATIONS

The present application claims priority under 35 U.S.C. §119 to Japanese Patent Application No. P2013-183646, filed Sep. 5, 2013. The contents of this application are herein incorporated by reference in their entirety.

BACKGROUND OF THE INVENTION

1. Field of Invention

The present invention relates to a fixing apparatus for fixing images formed on sheet and an image forming apparatus provided with this fixing apparatus.

2. Description of Related Art

In general, an image forming apparatus as an electrophotographic system (printer, copying machine, facsimile or the like) is provided with a fixing apparatus for applying heat and pressure to a sheet to fix a toner image transferred to the sheet. This fixing apparatus includes a heating unit for heating and melting toner on a sheet and a pressing unit for pressing the sheet against the heating unit.

For example, this type of fixing apparatus has been implemented as follows. Japanese Patent Published Application No. 6-250560 discloses a fixing apparatus having a nip portion which is formed between a fixing roller and a part of an endless belt wound on a plurality of rollers. The fixing apparatus also includes a pressure roller located in contact with the fixing roller through the endless belt from the inside of the endless belt at the exit of the nip portion. The fixing apparatus prevents displacement of images by exerting a braking force on the endless belt conveyed on the pressure roller in order to remove the difference in the conveyance speed between the pressure roller and the fixing roller.

On the other hand, Japanese Patent Published Application No. 09-138598 discloses a fixing apparatus provided with a pressure roller and a plurality of rollers on which a fixing belt is wound, and applies a braking force to the fixing belt by rotationally driving one of the plurality of rollers, and rotationally driving the other roller in the direction to inhibit the rotation of the one roller. In accordance with this configuration of this fixing apparatus, the fixing belt is stretched between the one roller and the other roller so that a nip portion is formed between the stretched portion of the fixing belt and the pressure roller to tightly contact the fixing belt with the outer peripheral surface of the pressure roller without gaps.

However, in the case where a plurality of sheets of a cardboard or a paper having a rough surface are successively passed through the fixing apparatus described in Japanese Patent Published Application No. 6-250560 or Japanese Patent Published Application No. 9-138598, the surface of the fixing belt is made rough at opposite side edges of these thick or rough sheets. If a large size sheet is passed through the fixing apparatus for fixing an image thereon after the thick or rough sheets, a gloss line may appear on the fixed image corresponding to the rough surface of the fixing belt such that the image looks less shiny in the gloss line than in other portions.

In order to solve this problem, for example, it may be effective to apply a driving force to one of a fixing and a back side member which are formed of the fixing belt and the rollers, and apply a braking force to the other, and recover the rough surface of the fixing side member and back side member by idle-rotating the fixing side member and the back side member for a certain time in a non-fixing period in which the nip width is made shorter than that in a fixing period.

However, depending upon the strength of the braking force, the motor driven to apply the braking force may be heated and therefore it is difficult to continuously perform the recovering process in an appropriate manner.

SUMMARY OF THE INVENTION

To achieve at least one of the abovementioned objects, a fixing apparatus comprises: a fixing side member located to face a fixing side of a sheet on which a toner image is formed; a back side member configured to form a fixing nip portion which holds and conveys the sheet when the back side member is urged against the fixing side member; a drive motor configured to rotate the back side member; a fixing nip width adjustment unit configured to adjust the fixing nip width of the fixing nip portion; a braking force generation motor configured to generate a braking force in the direction to hinder rotation of the fixing side member; a rotational speed detection unit configured to detect the rotational speed of the braking force generation motor; and a control unit configured to perform restore control for rotating the fixing side member and the back side member by driving the drive motor and perform speed keeping control for keeping the rotational speed of the braking force generation motor detected by the rotational speed detection unit no higher than a predetermined speed during the restore control in a non-fixing period in which the fixing nip width adjustment unit is controlled to decrease the fixing nip width smaller than in a fixing period and a braking force is applied to the fixing side member by the braking force generation motor.

Also, to achieve at least one of the above-mentioned objects, an image forming apparatus comprises: an image forming apparatus comprises: an image forming unit configured to form a toner image on a sheet; and a fixing unit as recited in the previous paragraph to fix the toner image formed on the sheet.

DETAILED DESCRIPTION OF THE PREFERRED EMBODIMENT

Hereinafter, a description is given of embodiment of the present invention with reference to the drawings.

Figure 1:
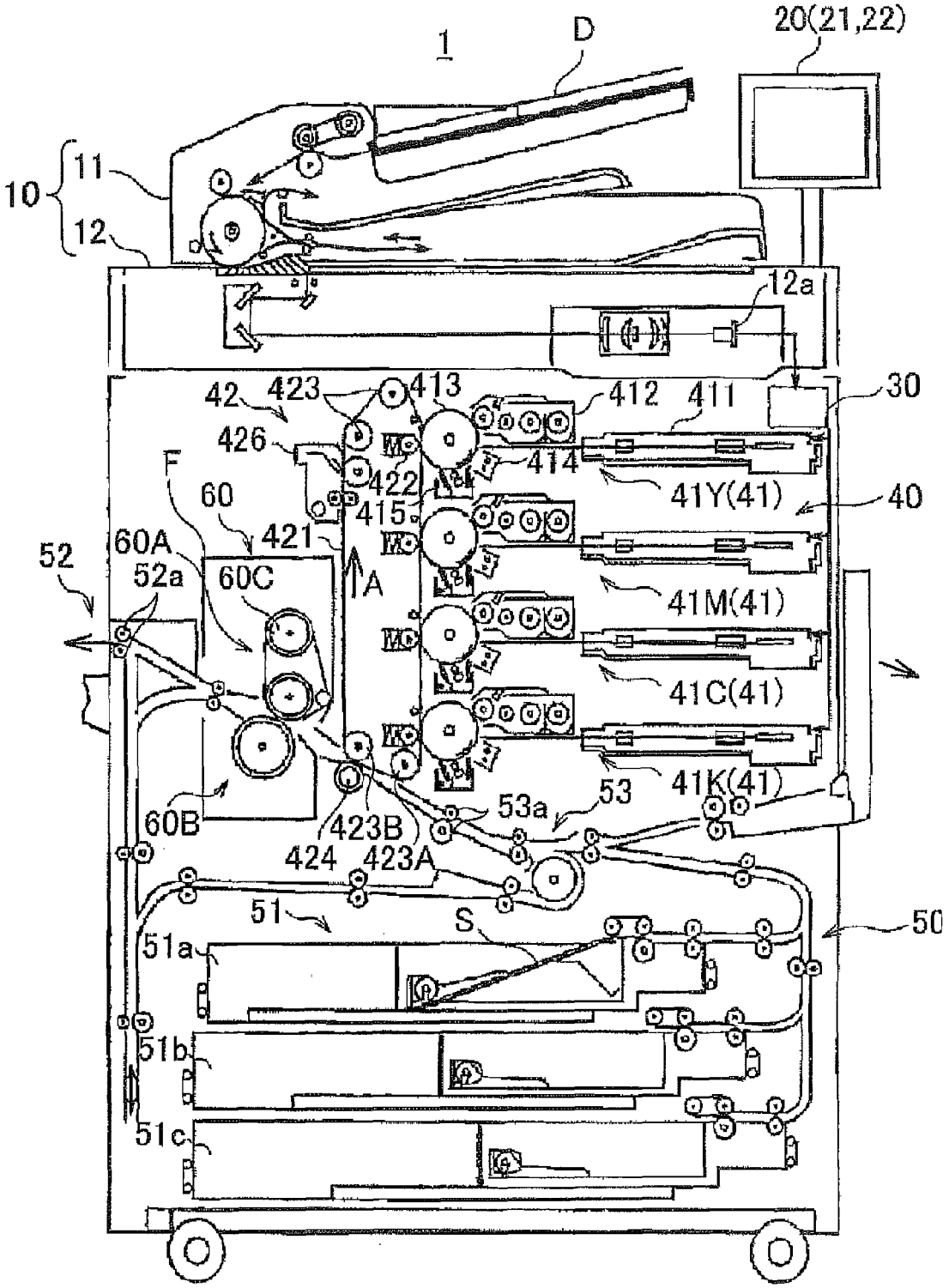
FIG. 1 is a schematic diagram for showing the overall configuration of an image forming apparatus in accordance with an embodiment of the present invention.
Figure 2:
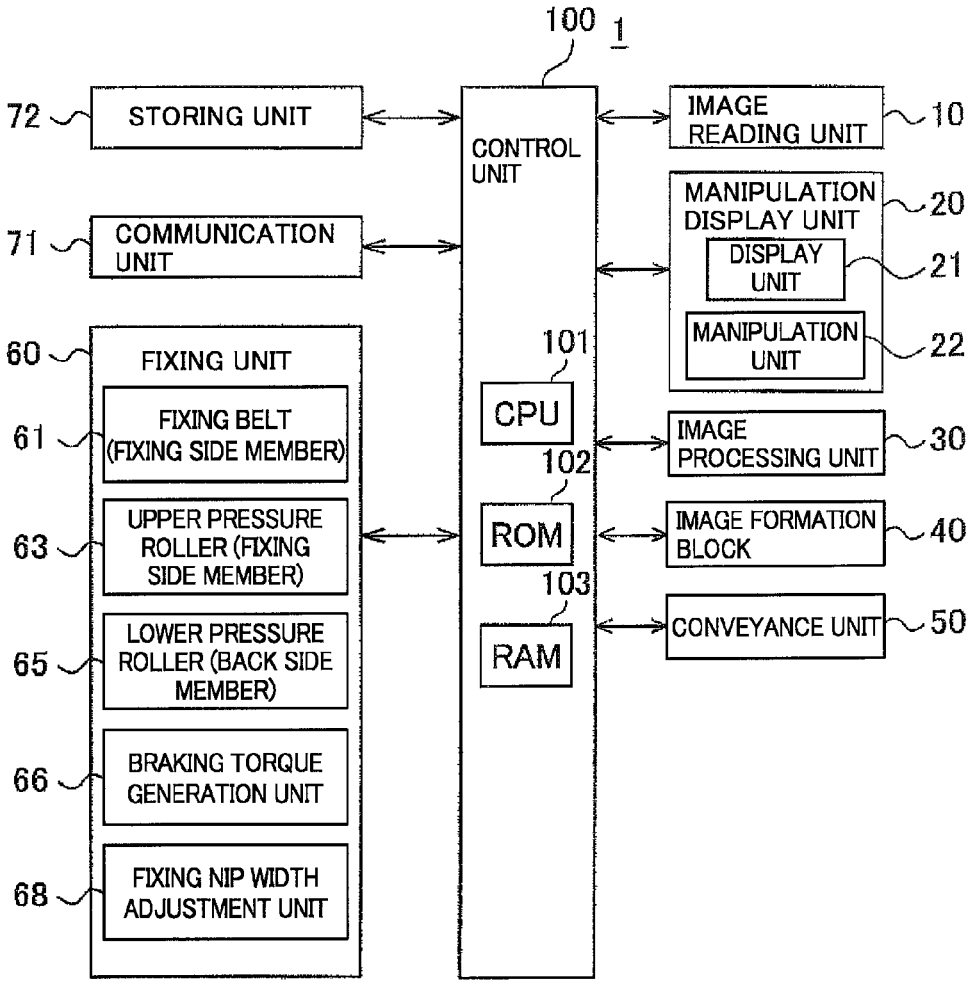
FIG. 2 is a schematic diagram for showing the main architecture of a control system of the image forming apparatus in accordance with the embodiment.

FIG. 1 is a schematic diagram for showing the overall configuration of the image forming apparatus 1 in accordance with an embodiment of the present invention. FIG. 2 is a schematic diagram for showing the main architecture of a control system of an image forming apparatus 1 in accordance with this embodiment. The image forming apparatus 1 shown in FIG. 1 and FIG. 2 is an intermediate transfer type color image forming apparatus which makes use of an electrophotographic process technique. Namely, the image forming apparatus 1 includes photoreceptor drums 413 and an intermediate transfer belt 421 and transfers toner images of respective colors, i.e., C (cyan), M (magenta), Y (yellow) and K (black) formed on the photoreceptor drums 413 respectively to the intermediate transfer belt 421 (as a first transfer process). After superimposing four color toner images on the intermediate transfer belt 421, an image is formed on a sheet by transferring the superimposed toner images (as a second transfer process).

The photoreceptor drums 413 of the image forming apparatus 1 are serially arranged in the running direction of the intermediate transfer belt 421 corresponding to the four colors C, M, Y and K respectively. The image forming apparatus 1 is based on a tandem system which successively transfers four color toner images on the intermediate transfer belt 421 in one cycle.

As shown in FIG. 1 and FIG. 2, the image forming apparatus 1 includes a print image reading unit 10, a manipulation display unit 20, an image processing unit 30, an image formation block 40, a conveyance unit 50, a fixing unit 60, a communication unit 71, a storing unit 72 and a control unit (control means) 100.

The control unit 100 includes a CPU (Central Processing Unit) 101, a ROM (Read Only Memory) 102 and RAM (Random Access Memory) 103 and the like. The CPU 101 reads a program from the ROM 102 in accordance with a task, loads the program in the RAM 103, and run the program to control the operations of the respective blocks of the image forming apparatus 1 integrally. At this time, the control unit 100 refers to a variety of data stored in the storing unit 72. The storing unit 72 stores various data items required for fixing process in the fixing unit 60. The storing unit 72 consists of a nonvolatile semiconductor device (so-called flash memory), a hard disk drive or the like.

The control unit 100 performs, through the communication unit 71, transmission to and reception from an external device (for example, a personal computer) which is connected to a LAN (Local Area Network), a WAN (Wide Area Network) or the like communication network. The control unit 100 receives image data, for example, from an external device, and forms an image on a sheet S on the basis of this image data (input image data). The communication unit 71 consists, for example, of a communication control card such as a LAN card.

The print image reading unit 10 is provided with an automatic page feeding unit 11 called an ADF (Auto Document Feeder), an original image scanning unit (scanner) 12 and the like.

The automatic page feeding unit 11 conveys an original D by a conveyance mechanism and transfers the original D to the original image scanning unit 12. The automatic page feeding unit 11 is capable of successively feeding a number of originals D to scan the images of the originals D (inclusive of the images of the back sides) collectively with the original image scanning unit 12.

The original image scanning unit 12 optically scans an original, which is conveyed from the automatic page feeding unit 11 and placed on a contact glass, and reads the image by imaging light reflected from the original on a light receiving plane of a CCD (Charge Coupled Device) sensor 12*a*. The print image reading unit 10 generates input image data on the basis of the scan data obtained by the original image scanning unit 12. This input image data is processed by the image processing unit 30 in accordance with a predetermined image process.

The manipulation display unit 20 is a liquid crystal display (LCD Liquid Crystal Display) with a touch panel and serves as a display unit 21 and a manipulation unit 22. The display unit 21 displays various operation screens, image conditions, the operational states of respective functions and so forth in accordance with a display control signal which is input from the control unit 100. The manipulation unit 22 is provided with a numerical keypad, a start key and other various operational keys, accepts various input operations from a user and outputs an operation signal to the control unit 100.

The image processing unit 30 is provided with a circuit or the like which performs digital image processes with the input image data on the basis of initial settings or user settings. For example, the image processing unit 30 performs gradation level adjustment with reference to gradation level adjustment data (a gradation level adjustment table) under the control of the control unit 100. In addition to the shading compensation, the image processing unit 30 also performs other processes with the input image data such as color correction, shading compensation and other various correction processes, and compression processes. The image formation block 40 is controlled on the basis of the image data processed by these processes.

The image formation block 40 is provided with image forming units 41Y, 41M, 41C and 41K, an intermediate transfer unit 42 and the like for forming an image on the basis of the input image data with colored toners corresponding to a Y component, an M component, a C component and a K component respectively.

The image forming units 41Y, 41M, 41C and 41K corresponding to the Y component, the M component, the C component and the K component share the same configuration except for the colors of the toners. For the sake of clarity in explanation and illustration, like numerals denote similar elements, and suffixes Y, M, C and K may be added to the ends of the numerals respectively for distinguishing from each other. In FIG. 1, only the constituent elements of the image forming unit 41Y are given reference numerals corresponding to the Y component, but the reference numerals are omitted for the constituent elements of the other image forming units 41M, 41C and 41K.

The image forming unit 41 is provided with an exposing device 411, a development apparatus 412, a photoreceptor drum 413, a charging unit 414, a drum cleaning unit 415, and the like.

The photoreceptor drum 413 consists, for example, of a conductive cylinder (aluminum blank tube) on which an under coat layer (UCL layer), a charge generation layer (CGL layer), and a charge transport layer (CTL layer) are successively stacked as a negative electrification type organic photoconductor (OPC).

The charging unit 414 uniformly charges the surface of the photoreceptor drum 413 having photoconductivity with negative charge. The exposing device 411 consists, for example, of a semiconductor laser and irradiates the photoreceptor drum 413 with a laser light corresponding to an image of the color component which the photoreceptor drum 413 is responsible for. The laser light generates positive charge in the charge generation layer. The generated charge is transported to the surface of the charge transport layer to neutralize the surface charge (negative charge) of the photoreceptor drum 413. An electrostatic latent image is formed on the surface of the photoreceptor drum 413 corresponding to each color component by the potential difference between the surface and the environment.

The development apparatus 412 is, for example, a two-component developing apparatus which forms a toner image by having toners of the respective color components adhere to the surface of the photoreceptor drums 413 respectively to visualize electrostatic latent images.

The drum cleaning unit 415 has a drum cleaning blade which is in slidable contact with the surface of the photoreceptor drum 413. A DCL blade is provided for scraping and removing the residual toner which is lingering on the surface of the photoreceptor drum 413 after the first transfer process.

The intermediate transfer unit 42 is provided with the intermediate transfer belt 421, first transfer rollers 422, a plurality of support rollers 423, a second transfer roller 424, and a belt cleaning unit 426 and so forth.

The intermediate transfer belt 421 is an endless belt which is wound around the plurality of support rollers 423 in the form of a loop. At least one of the plurality of support rollers 423 consists of a drive roller, and the others consist of non-driven rollers respectively. For example, preferably, a roller 423A is implemented as the drive roller in this case. This is because the running speed of the intermediate transfer belt 421 can easily be kept constant if the drive roller is located downstream in the belt running direction as seen from the first transfer roller 422 that is provided for K component. When the drive roller 423A rotates, the intermediate transfer belt 421 runs at a constant speed in the direction indicated with arrow A.

The first transfer rollers 422 are arranged in the inner surface side of the intermediate transfer belt 421 and opposed to the photoreceptor drums 413 through the intermediate transfer belt 421 in correspondence with the color components respectively. First transfer nip portions are thereby formed by urging the first transfer rollers 422 against the photoreceptor drums 413 respectively with the intermediate transfer belt 421 therebetween for transferring the toner images from the photoreceptor drums 413 to the intermediate transfer belt 421.

The second transfer roller 424 is located in the outer surface side of the intermediate transfer belt 421 and opposed to the roller 423B (hereinafter referred to as "backup roller 423B") which is located downstream in the belt running direction as seen from the drive roller 423A. A second transfer nip portion is formed by urging the second transfer roller 424 against the backup roller 423B with the intermediate transfer belt 421 therebetween for transferring the toner images from the intermediate transfer belt 421 to a sheet S.

When the intermediate transfer belt 421 is passed through the first transfer nip portions, toner images are successively transferred from the photoreceptor drums 413 and superimposed on the intermediate transfer belt 421 respectively as a first transfer process. More specifically, a first transfer bias voltage is applied to the first transfer rollers 422 in order to charge the rear surface (which contacts the first transfer rollers 422) of the intermediate transfer belt 421 with electricity of the polarity opposite to that of toner so that the toner images are electrostatically transferred to the intermediate transfer belt 421.

The superimposed toner image on the intermediate transfer belt 421 is then transferred to a sheet S which is passed through the second transfer nip portion as a second transfer process. More specifically, a second transfer bias voltage is applied to the second transfer roller 424 in order to charge the back side (which contacts the second transfer roller 424) of the sheet S with electricity of the polarity opposite to that of toner so that the superimposed toner image is electrostatically transferred to the sheet S. The sheet S with the transferred toner image is conveyed to the fixing unit 60.

The belt cleaning unit 426 includes a belt cleaning blade, which is in slidable contact with the surface of the intermediate transfer belt 421, for removing toner which remains on the surface of the intermediate transfer belt 421. Incidentally, the function of the second transfer roller can be implemented by an alternative structure (so-called belt-type second transfer unit) consisting of a second transfer belt which is wound around a plurality of support rollers including the roller 424 in the form of a loop.

The fixing unit 60 is provided with an upper fixing unit 60A having a fixing side member located in the fixing surface side (on which the toner image is formed) of a sheet S, a lower fixing unit 60B having a back side member located in the rear surface side (opposite to the fixing surface) of the sheet S, a heat source 60C and so forth. A fixing nip portion capable of holding a sheet S inbetween is formed by urging the member supporting the back side of the sheet against the fixing side member.

The sheet S to which a toner image is transferred by the second transfer process is conveyed to the fixing unit 60 which fixes the toner image to the sheet S with heat and pressure by passing the sheet S through the fixing nip portion. The fixing unit 60 is placed in a fixing device F as a functional unit. Also, the fixing device F may also includes an air separation unit which separates a sheet S from the fixing side member or the back side supporting member by blowing air. Incidentally, the fixing unit 60 will be described later in details.

The paper conveying unit 50 includes a paper feed unit 51, a discharging unit 52, a conveyance passage section 53 and so forth. The paper feed unit 51 includes three paper feed tray units 51*a* to 51*c* for storing sheets S (standard sheets, special sheets) which are classified on the basis of paper densities and sizes of sheets and separately stored in the paper feed tray units 51*a* to 51*c* in accordance with predetermined sheet types respectively. The conveyance passage section 53 is provided with a plurality of conveyance roller pairs such as a paper stop roller pair 53*a*.

The sheets S stored in each of the paper feed tray units 51*a* to 51*c* are fed out from the uppermost sheet one by one, and conveyed to the image formation block 40 through the conveyance passage section 53. The orientation and transfer timing of the sheet S which is fed are adjusted by a paper stop roller unit including the paper stop roller pair 53*a*. The toner image formed on the intermediate transfer belt 421 is transferred on one side of the sheet S as the second transfer process in the image formation block 40, and fixed by the fixing unit 60 as a fixing process. The sheet S to which the image is fixed is discharged out of the apparatus by the discharging unit 52 having discharging rollers 52*a*.

Figure 3:
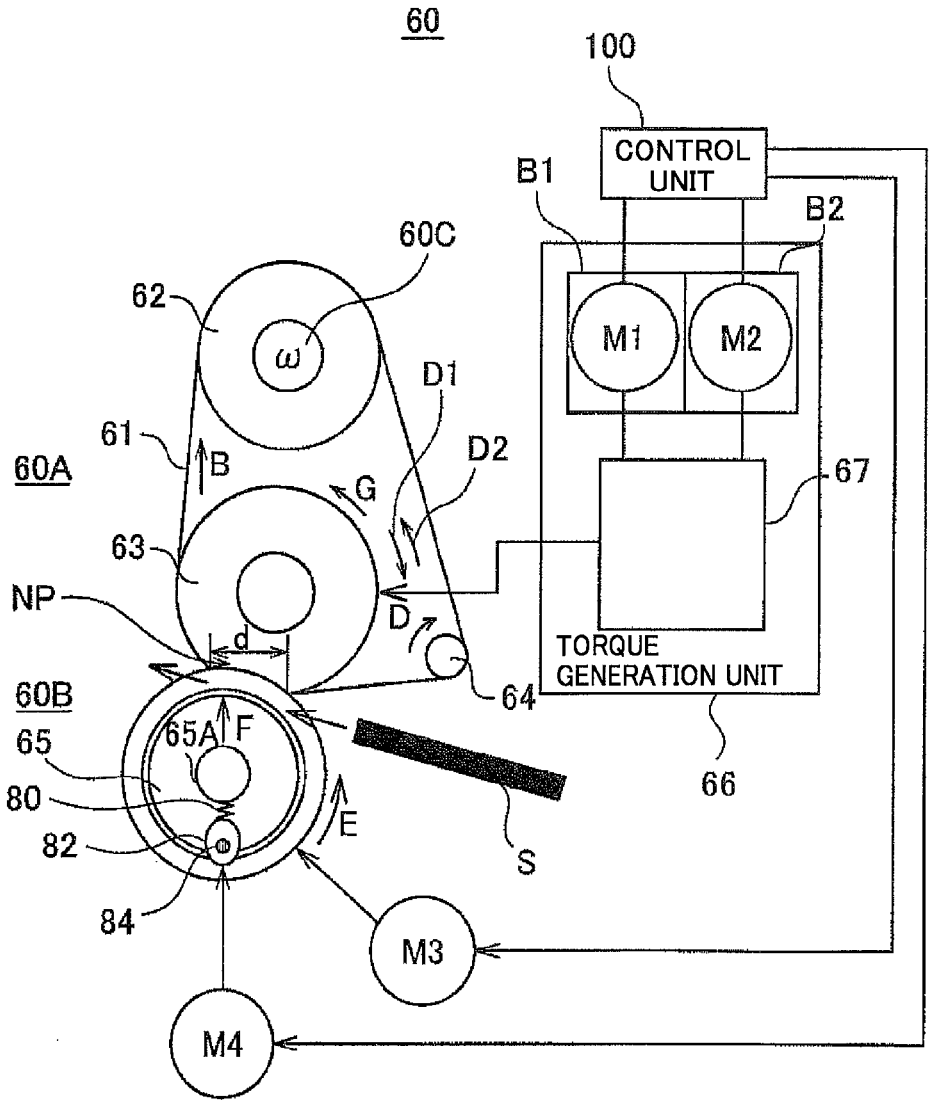
FIG. 3 is a schematic diagram for showing the configuration of the fixing unit shown in FIG. 1.

Next, referring to FIG. 3, the structure of the fixing unit 60 will be explained. FIG. 3 is a schematic diagram for showing the structure of the fixing unit 60.

Incidentally, the fixing unit 60 and the control unit 100 serve as a fixing apparatus. The fixing unit 60 and the control unit 100 can be installed in the image forming apparatus 1 as a single unit or separate units serving as a fixing apparatus.

The upper fixing unit 60A includes an endless fixing belt (fixing side member) 61, a heat roller 62, an upper pressure roller (fixing side member) 63 and a stretching member 64. The upper fixing unit 60A is formed with belt heating system. The fixing belt 61 is wound and stretched around the heat roller 62, the upper pressure roller 63 and the stretching member 64 with a predetermined belt tension (for example, 400[N]).

For example, the fixing belt 61 has an outer diameter of 120 [mm] and is made of a PI (polyimide) base layer having a thickness of 70 [μm]. The outer peripheral surface of the fixing belt 61 is coated with an elastic layer made of a heat resistant silicone rubber layer having a thickness of 200 [μm] and a hardness of JIS-A30[°]. The surface of the fixing belt 61 is further coated with a PFA (perfluoroalkoxyethylene) tube having a thickness of 30 [μm] as a heat resistant resin layer. The fixing belt 61 forms a fixing nip portion NP in cooperation with a lower pressure roller 65.

The fixing belt 61 comes in contact with a sheet S on which a toner image is formed, and thermally fixes the toner image on the sheet S at a fixing temperature (for example, 160 to 200[° C.]). In this case, the fixing temperature is a temperature which can supply necessary heat for melting toner on the sheet S and depends on the paper type of the sheet S or the like.

The heat roller 62 heats the fixing belt 61. The heat roller 62 incorporates the heat source 60C (halogen heater) for heating the fixing belt 61. The heat roller 62 is made of aluminum or the like in the form of a cylindrical metallic core having an outer diameter of 58 [mm] with a resin layer of PTFE coated on the outer peripheral surface thereof.

The temperature of the heat source 60C is controlled by the control unit 100. The heat source 60C heats the heat roller 62, and heats the fixing belt 61 through the heat roller 62.

The upper pressure roller 63 is made of iron or the like in the form of a cylindrical metallic solid core having an outer diameter of 70 [mm], and coated with a resin layer, which is made of a heat resistant silicone rubber and has a thickness of 5 to 30 [μm] and a hardness of Asker-C35[°]. The surface of the upper pressure roller 63 is further coated with a resin layer having a thickness of 5 to 30 [μm] and made of PTFE which is a low-friction heat resistant material.

The upper pressure roller 63 is located to press, through the fixing belt 61, the lower pressure roller 65 which is driven to rotate by a main driving source (drive motor M3) of the fixing unit 60. A braking torque generation unit 66 is connected to the upper pressure roller 63.

The braking torque generation unit 66 is provided with a braking force generation motor M1, and generates a braking torque in the direction of arrow G in response to a control command output from the control unit 100. Particularly, the braking torque generation unit 66 is provided also with an assist force generation motor M2 in addition to the braking force generation motor M1. These motors M1 and M2 apply opposite torques respectively to the upper pressure roller 63. Specifically, in order to generate a braking force D2 against the rotation (forward rotation) of the upper pressure roller 63 corresponding to the conveying direction, the braking force generation motor M1 applies a torque opposite to the forward rotation to the upper pressure roller 63 which is rotating following the lower pressure roller 65. In other words, the motor M1 generates the braking force D2 against the upper pressure roller 63.

On the other hand, the assist force generation motor M2 generates an assist force D1 to rotate the upper pressure roller 63 in the direction corresponding to the transfer direction by applying a torque to assist the upper pressure roller 63 which is rotating following the lower pressure roller 65.

Incidentally, the gear mechanism unit 67 includes a plurality of gear groups for separately transmitting the rotations of the motors M1 and M2 to the upper pressure roller 63, and transmits the torques of the first and second motors M1 and M2 in combination to the upper pressure roller 63 through these gear groups.

Figure 4:
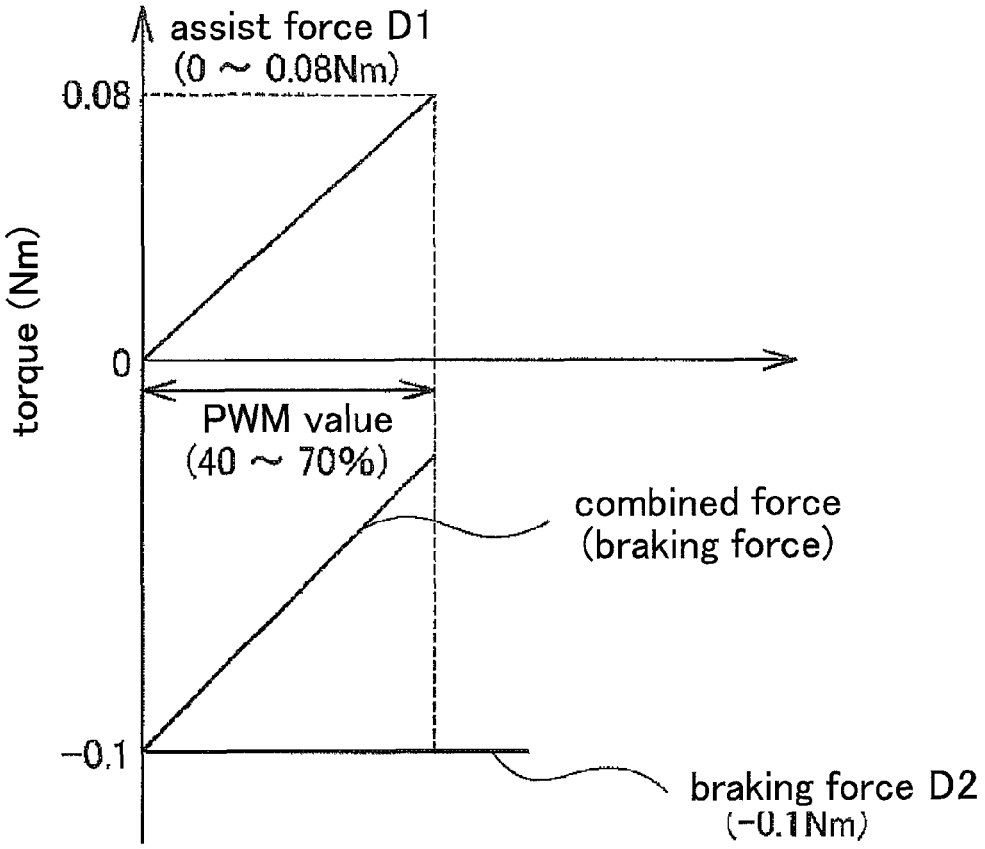
FIG. 4 is a schematic diagram for showing the effective braking force generated by the torque generation unit shown in FIG. 3.

FIG. 4 is a schematic diagram for showing the effective braking force generated by the braking torque generation unit 66. As shown in FIG. 4, the torque (braking force D2) generated by the braking force generation motor M1 is constant, i.e., −0.1 Nm in this case. On the other hand, the assist force generation motor M2 is controlled by the control unit 100 in accordance with PWM (Pulse Width Modulation) to generate a variable torque (assist force D1) in a range of 0 Nm to 0.08 Nm (PWM value=40% to 70% in terms of duty cycle). The assist force D1 is thus always smaller than the braking force D2 (exactly, the absolute value of the assist force D1 is always smaller than the absolute value of the braking force D2), such that the combined force of the assist force D1 and the braking force D2 becomes a variable braking force. The combined force is the effective braking force generated by the torque generation unit 66 and exerted on the upper pressure roller 63 to reduce the surface speed (circumferential speed) of the upper pressure roller 63 in relation to the lower pressure roller 65.

Figure 5:
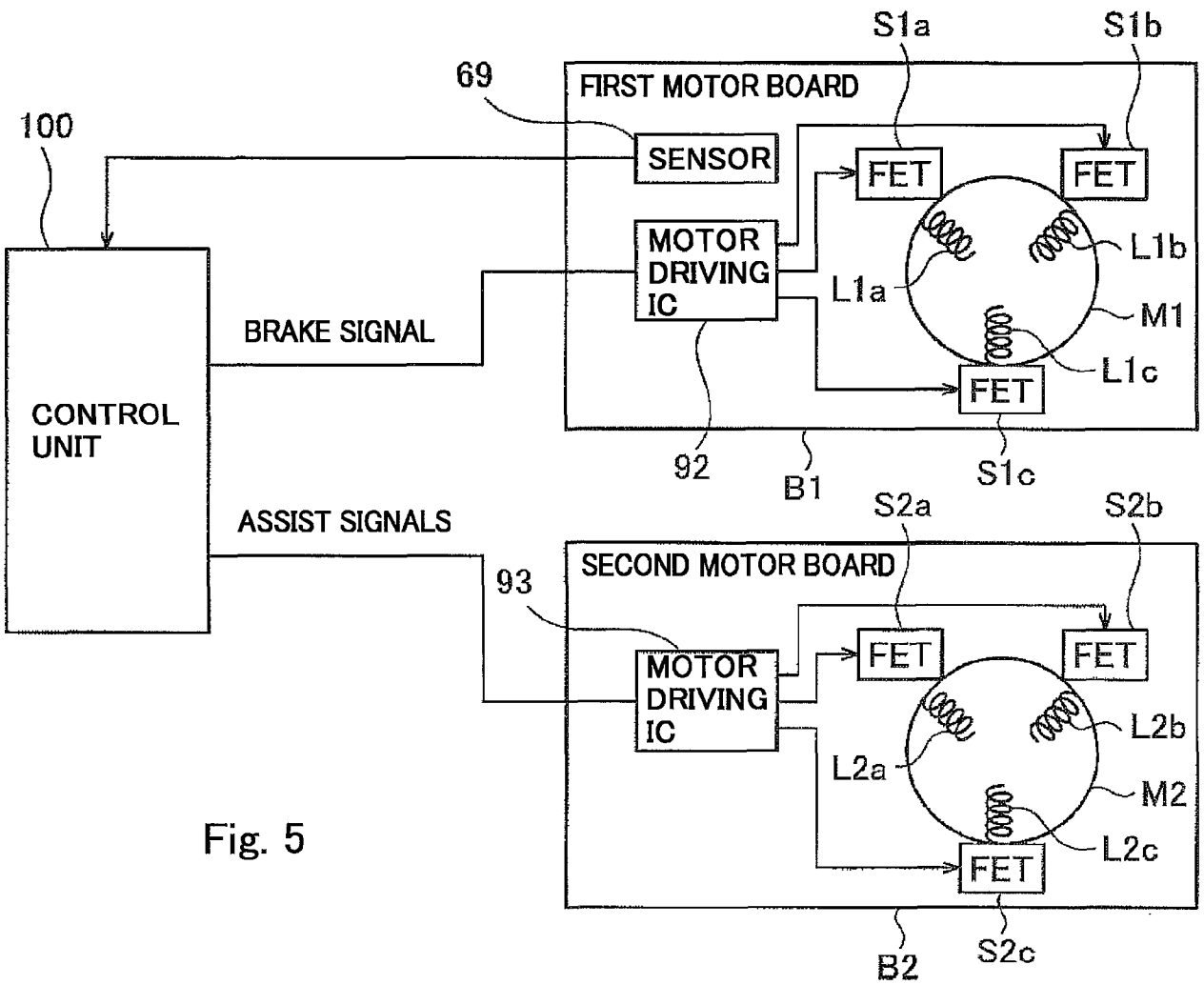
FIG. 5 is a block diagram for partially showing the configuration of the fixing unit shown in FIG. 3 in detail.

In what follows, further explanation is given. FIG. 5 is a block diagram for partially showing the configuration of the fixing unit 60 shown in FIG. 3 in detail.

As shown in FIG. 5, the fixing unit 60 includes motor boards B1 and B2 connected to the control unit 100, and a rotational speed detection sensor (rotational speed detection unit) 69.

The first motor board B1 includes driver circuits (motor driving IC 92 and FETs S1*a* to S1*c*) for driving the braking force generation motor M1. The second motor board B2 includes driver circuits (motor driving IC 93 and FETs S2*a* to S2*c*) for driving the assist force generation motor M2. The motor driving IC 92 of the first motor board B1 serves to turn on/off the FETs S1*a* to S1*c*. Likewise, the motor driving IC 93 of the second motor board B2 serves to turn on/off FETs S2*a* to S2*c*.

When applying an effective braking force to the upper pressure roller 63, the control unit 100 outputs assist signals to the second motor board B2. The motor driving IC 93 of the second motor board B2 receives the assist signals and turns on/off the FETs S2*a* to S2*c*. Current is passed with appropriate timings through coils L2*a* to L2*c* forming the stators of the motor M2 respectively to rotate the rotors (not shown in the figure). At this time, the motor driving IC 93 turns on/off FETs S2*a* to S2*c* in accordance with a PWM signal contained in the assist signals to adjust the assist force D1.

On the other hand, when applying an effective braking force to the upper pressure roller 63, the control unit 100 outputs a brake signal to the first motor board B1. When receiving the brake signal, the motor driving IC 92 of the first motor board B1 turns on one of the FETs S1*a* to S1*c* to pass current through the corresponding one of the coils L1*a* to L1*c* of the braking force generation motor M1. A magnetic force is thereby exerted on the rotor corresponding to the FET which is turned on to hinder the rotation of this rotor to generate the braking force D2 having a constant value.

Furthermore, as shown in FIG. 5, the fixing unit 60 of the present embodiment is provided with the rotational speed detection sensor 69. The rotational speed detection sensor 69 is used to detect the rotational speed (number of rotations) of the braking force generation motor M1. The control unit 100 receives a signal indicative of the rotational speed detected by the rotational speed detection sensor 69.

The lower fixing unit 60B includes, for example, the lower pressure roller 65 which is a back side member to form a roller pressing configuration. The lower pressure roller 65 is made of aluminum or the like in the form of a cylindrical metallic core having an outer diameter of 70 [mm]. The outer peripheral surface of the cylindrical metallic core is coated with an elastic layer made of a heat resistant silicone rubber layer having a thickness of 1 to 3 [μm] and a hardness of JIS-A30 [°]. The surface of this elastic layer is further coated with a resin layer made of a PFA tube having a thickness of 30 to 100 [μm].

The drive motor M3 receives a control command output from the control unit 100, and drives the lower pressure roller 65 in a direction indicated with arrow E (the counter clockwise direction). The control unit 100 drives (e.g., turns on/off, controls the circumferential speed of) the drive motor M3.

The lower pressure roller 65 incorporates a heat source such as a halogen heater (not shown in the figure). This heat source generates heat to heat the lower pressure roller 65. The control unit 100 controls power supply to the heat source, and keeps the lower pressure roller 65 at a predetermined temperature (for example, 80 to 120[° C.]).

The end portion 65A of the rotation axis of the lower pressure roller 65 is connected to the motor M4 through a pushing spring 80 and a slide cam 82. The motor M4 receives a control command output from the control unit 100, and drives the slide cam 82 to rotate around a shaft 84. When the motor M4 rotates the slide cam 82, the lower pressure roller 65 is urged through the pushing spring 80 in the direction indicated with arrow F. The lower pressure roller 65 can be urged against or separated from the fixing belt 61 in accordance with the rotational position of the slide cam 82. When the lower pressure roller 65 is urged against the fixing belt 61, the lower pressure roller 65 bites into (depresses the contact surface of) the elastic layer of the upper pressure roller 63 through the fixing belt 61 by a bite amount (depression amount) which varies corresponding to the rotational position of the slide cam 82. By this configuration, it is possible to vary the fixing nip width "d" of the fixing nip portion NP formed between the fixing belt 61 the lower pressure roller 65, i.e., the length of the fixing nip portion NP in the conveying direction of a sheet S. Namely, the fixing nip width "d" of the fixing nip portion NP increases as the bite amount of the lower pressure roller 65 into the elastic layer of the upper pressure roller 63 increases. Conversely, the fixing nip width "d" of the fixing nip portion NP decreases as the bite amount of the lower pressure roller 65 decreases.

That is to say, the motor M4, the slide cam 82 and the pressure spring 80 function in combination as a fixing nip width adjustment unit 68 which can be used to adjust the fixing nip width "d" of the fixing nip portion NP.

The lower pressure roller 65 is urged against the upper pressure roller 63 through the fixing belt 61 by the fixing nip width adjustment unit 68 with a predetermined fixing load (for example, 2650[N]). The fixing nip portion NP can be formed between the fixing belt 61 and the lower pressure roller 65 between which a sheet S is held and conveyed.

When the lower pressure roller 65 is driven to rotate in the direction indicated with arrow E, the fixing belt 61 rotates in the direction (clockwise direction) indicated with arrow B to follow the rotation of the lower pressure roller 65. The upper pressure roller 63 also rotates in the direction (clockwise direction) indicated with arrow C.

In this case, the control unit 100 of the present embodiment performs restore control, speed keeping control and gloss improvement control.

The restore control is a control for restoring the surface of the fixing belt 61 to remove a gloss line. This restore control is performed in a non-fixing period in which no sheet S is held and conveyed by the fixing nip portion NP. At this time, the control unit 100 controls the fixing nip width adjustment unit 68 to decrease the fixing nip width "d" in a non-fixing period smaller than the fixing nip width "d" in a fixing period. Namely, the control unit 100 decrease the bias force of the pressure spring 80 exerted on the lower pressure roller 65 in the direction indicated with arrow F by driving the motor M4 to rotate the slide cam 82. The control unit 100 can thereby make the fixing nip width "d" smaller.

Furthermore, the control unit 100 rotates the fixing belt 61 and the lower pressure roller 65 by driving the drive motor M3 while the effective braking force is exerted on the upper pressure roller 63 by the braking torque generation unit 66 (the braking force generation motor M1). At this time, the following rotation of the upper pressure roller 63 and the fixing belt 61 is hindered by the braking torque generation unit 66 so that the fixing belt 61 rotates at a slower circumferential speed than the lower pressure roller 65. A difference in circumferential speed occurs between the fixing belt 61 and the lower pressure roller 65. The control unit 100 of the present embodiment controls the braking torque generation unit 66 and sets up the magnitude of the braking torque in accordance with the differential circumferential speed between the fixing belt 61 and the lower pressure roller 65. The differential circumferential speed can be increased by increasing the braking torque, and decreased by decreasing the braking torque.

As has been discussed above, if sheets S of a cardboard or a paper having a rough surface are passed through the fixing nip portion NP, the surface of the fixing belt 61 is scratched at opposite side edges of these thick or rough sheets. When forming an image on a large size sheet S in an image formation area covering this paper edge scratch, the fixing process cannot be performed uniformly in the sheet width direction due to the paper edge scratch so that a gloss line may appear on the fixed image.

Contrary to this, the fixing apparatus of the present embodiment restores the surface of the fixing belt 61 having the paper edge scratch by driving the fixing belt 61 and the lower pressure roller 65 with the differential circumferential speed to rub the fixing belt 61 with the lower pressure roller 65.

Incidentally, depending upon the condition of the fixing nip portion NP formed between the fixing belt 61 and the lower pressure roller 65, it may be impossible to drive the fixing belt 61 and the lower pressure roller 65 to rotate with a desired differential circumferential speed therebetween because the surface of the fixing belt 61 can hardly slide over the surface of the lower pressure roller 65. In this case, since the fixing belt 61 cannot sufficiently be rubbed with the lower pressure roller 65, the paper edge scratch may not be repaired in the fixing belt 61 so that the gloss line due to the paper edge scratch may not surely be prevented from occurring.

The control unit 100 of the present embodiment thereby controls the fixing nip width adjustment unit 68 such that the fixing nip width "d" of the fixing nip portion NP in a non-fixing period is narrower than in a fixing period. With this narrower fixing nip width "d", the control unit 100 drives the fixing belt 61 and the lower pressure roller 65 to rotate with a desired differential circumferential speed therebetween and rub the fixing belt 61 and the lower pressure roller 65 with each other. The surface of the fixing belt 61 can easily slide over the surface of the lower pressure roller 65 due to the fixing nip width "d" of the fixing nip portion NP which is narrower than in a fixing period. Because of this, the fixing belt 61 and the lower pressure roller 65 can be driven to rotate with a desired differential circumferential speed therebetween. It is therefore possible to rub the fixing belt 61 and the lower pressure roller 65 with each other and restore the fixing belt 61 by sufficiently making smooth paper edge scratch occurring on the fixing belt 61. Even when an image is formed thereafter on a large size sheet S in an image formation area covering this paper edge scratch, it is possible to surely avoid the situation that the fixing process cannot be performed uniformly in the sheet width direction due to the paper edge scratch so that a gloss line appears on the fixed image.

Namely, such restore control makes the fixing belt 61 and the lower pressure roller 65 rotate with a desired differential circumferential speed therebetween to rub them with each other. At this time, since the fixing nip width "d" in a non-fixing period is made smaller than the fixing nip width "d" in a fixing period and thereby the fixing belt 61 and the lower pressure roller 65 are apt to slip, it is possible to restore the fixing belt 61 and remove a gloss line by sufficiently rubbing the fixing belt 61 and the lower pressure roller 65 together.

On the other hand, the speed keeping control is a control to keep the rotational speed of the braking force generation motor M1 no higher than a predetermined speed during the restore control. The braking force generation motor M1 is driven for keeping the positions of its rotors to generate a braking force, but actually forced to rotate in the same direction as the assist force generation motor M2 by the upper pressure roller 63 which rotates to follow the rotation of the lower pressure roller 65. If this rotational speed becomes too high, a large amount of heat is generated in the braking force generation motor M1 and may be a cause of failure. Because of this, the control unit 100 performs the speed keeping control to keep the rotational speed of the braking force generation motor M1 no higher than a predetermined speed during the restore control. The control unit 100 controls the rotational speed of the braking force generation motor M1 by adjusting the rotational speed of the drive motor M3 to perform this speed keeping control.

It is therefore possible to inhibit heat generation of the braking force generation motor M1 by performing the speed keeping control during the restore control and continuously perform the restore control for removing a gloss line in an appropriate manner.

On the other hand, the gloss improvement control is a control to hold and convey a sheet S by driving the drive motor M3 and rotating the fixing belt 61 and the lower pressure roller 65 while an effective braking force is exerted on the upper pressure roller 63 by the braking force generation motor M1 and the assist force generation motor M2. The fixing belt 61 can thereby slide over the sheet S in a fixing period to prevent the gloss memory. Furthermore, the gloss memory can be prevented without need for additional mechanical parts to the fixing apparatus which is capable of resolving the gloss line problem and heat generation of the braking force generation motor M1, and therefore cost increase can be suppressed.

The aforementioned restore control is preferably performed with the timing that the sheet S conveyed to the fixing nip portion NP is switched to a wider sheet S. This makes it possible to remove the gloss line in an appropriate manner by performing the restore control with the timing when there is the possibility that a gloss line is formed.

Still further, while the fixing nip width "d" in a non-fixing period is decreased by the fixing nip width adjustment unit 68 to be narrower than in a fixing period, the control unit 100 reduces the execution time of the restore control as the fixing nip width "d" in a non-fixing period decreases. Because of this, in such a situation that the fixing belt 61 can easily slide over the lower pressure roller 65 with a narrower fixing nip width "d" and thereby the gloss line problem can be resolved quickly, the execution time of the restore control is shortened to prevent the reduction in productivity due to the long-time restore control.

Figure 6:
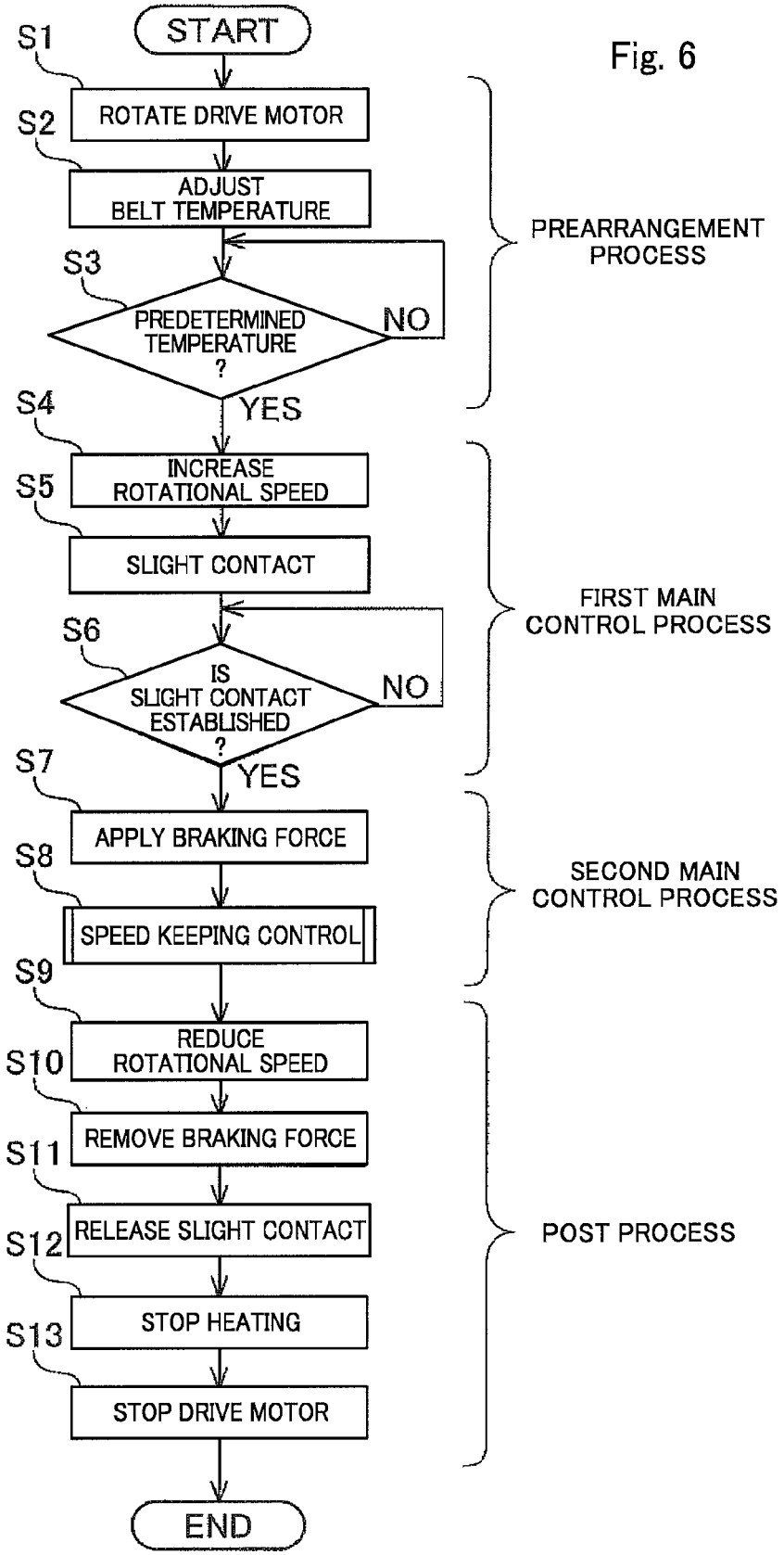
FIG. 6 is a flow chart showing the operation of the fixing apparatus in accordance with the present embodiment and including restore control and speed keeping control.

Next, the operation of the fixing apparatus of the present embodiment will be explained. FIG. 6 is a flow chart showing the operation of the fixing apparatus in accordance with the present embodiment and including the restore control and the speed keeping control.

The process shown in FIG. 6 consists mainly of four processes, i.e., a prearrangement process, a first main control process, a second main control process and a post process which are performed as the restore control in combination. The speed keeping control is implemented as part of the second main control process.

First, the control unit 100 starts the prearrangement process by driving the drive motor M3 to rotate (S1). In this case, the control unit 100 drives the drive motor M3 to rotate, for example, at 230 mm/s and controls the braking torque generation unit 66 to generate no effective braking force.

Next, the control unit 100 controls the heat source 60C to adjust the temperature of the fixing belt 61, for example, equivalent to the temperature required for warming up (S2). The control unit 100 then determines whether or not the temperature of the fixing belt 61 has risen to the predetermined temperature or higher (S3). Specifically, the control unit 100 determines, on the basis of a temperature signal output from a temperature sensor (not shown in the figure), whether or not the temperature of the fixing belt 61 is no lower than 80° C. and no higher than 230° C. If the temperature of the fixing belt 61 is lower than 80° C., since waste toner lingering on the fixing belt 61 and the lower pressure roller 65 is not softened, the surface of the fixing belt 61 and/or the surface of the lower pressure roller 65 may be scratched when rubbing the fixing belt 61 and the lower pressure roller 65. Also, if the temperature of the fixing belt 61 is lower than 80° C., the diameter of the elastic layer of the upper pressure roller 63 decreases. In other words, this decreases the bite amount of the lower pressure roller 65 into the elastic layer of the upper pressure roller 63 and makes the fixing nip width "d" of the fixing nip portion NP narrow. Because of the narrow fixing nip width "d", excessive slip may occur between the surface of the fixing belt 61 and the surface of the lower pressure roller 65 to scratch the surface of the fixing belt 61 Also, the heat resistant temperature of the silicone rubber used for the fixing belt 61 and the lower pressure roller 65 is about 230° C. so that the upper limit of the set temperature of the fixing belt 61 is set to 230° C.

Incidentally, the predetermined temperature is preferably set to a temperature equivalent to the temperature which is set up for fixing process (fixing temperature), for example, 180° C. This makes it possible to omit the step of changing the temperature of the fixing belt 61 when switching to an ordinary print process after the process shown in FIG. 6 is finished.

If it is determined that the temperature of the fixing belt 61 has not risen to the predetermined temperature or higher yet (S3: NO), this step S3 is repeated until the temperature is determined as having risen to the predetermined temperature or higher. Conversely, if it is determined that the temperature of the fixing belt 61 has risen to the predetermined temperature or higher (S3: YES), the prearrangement process is finished and the process proceeds to the first main control process.

The control unit 100 starts the first main control process by increasing the rotational speed of the drive motor M3 (S4). In this case, the control unit 100 drives the drive motor M3 to rotate, for example, at 460 mm/s, and controls the braking torque generation unit 66 to generate no effective braking force.

The control unit 100 then drives the drive motor M4 to rotate the slide cam 82 and urge the lower pressure roller 65 in the direction indicated with arrow F in order that the fixing belt 61 and the lower pressure roller 65 are in slight contact with each other (S5). The fixing nip width "d" in this slight contact condition is set to be smaller than in a fixing period. More specifically, if the fixing nip width "d" in a fixing period is 23 to 24 mm, the fixing nip width "d" in the slight contact condition is 8 to 11 mm, which is about ½ to ⅓ of the fixing nip width "d" in a fixing period.

Next, the control unit 100 determines whether or not the slight contact condition has been established (S6). If it is determined that the slight contact condition has not been established yet (S6: NO), this step S6 is repeated until the slight contact condition is determined as having been established. Conversely, if it is determined that the slight contact condition has been established (S6: YES), the first main control process is finished and the process proceeds to the second main control process.

The control unit 100 starts the second main control process by controlling the braking torque generation unit 66 to apply an effective braking force to the upper pressure roller 63 (S7). Next, the control unit 100 performs the speed keeping control process (S8).

Figure 7:
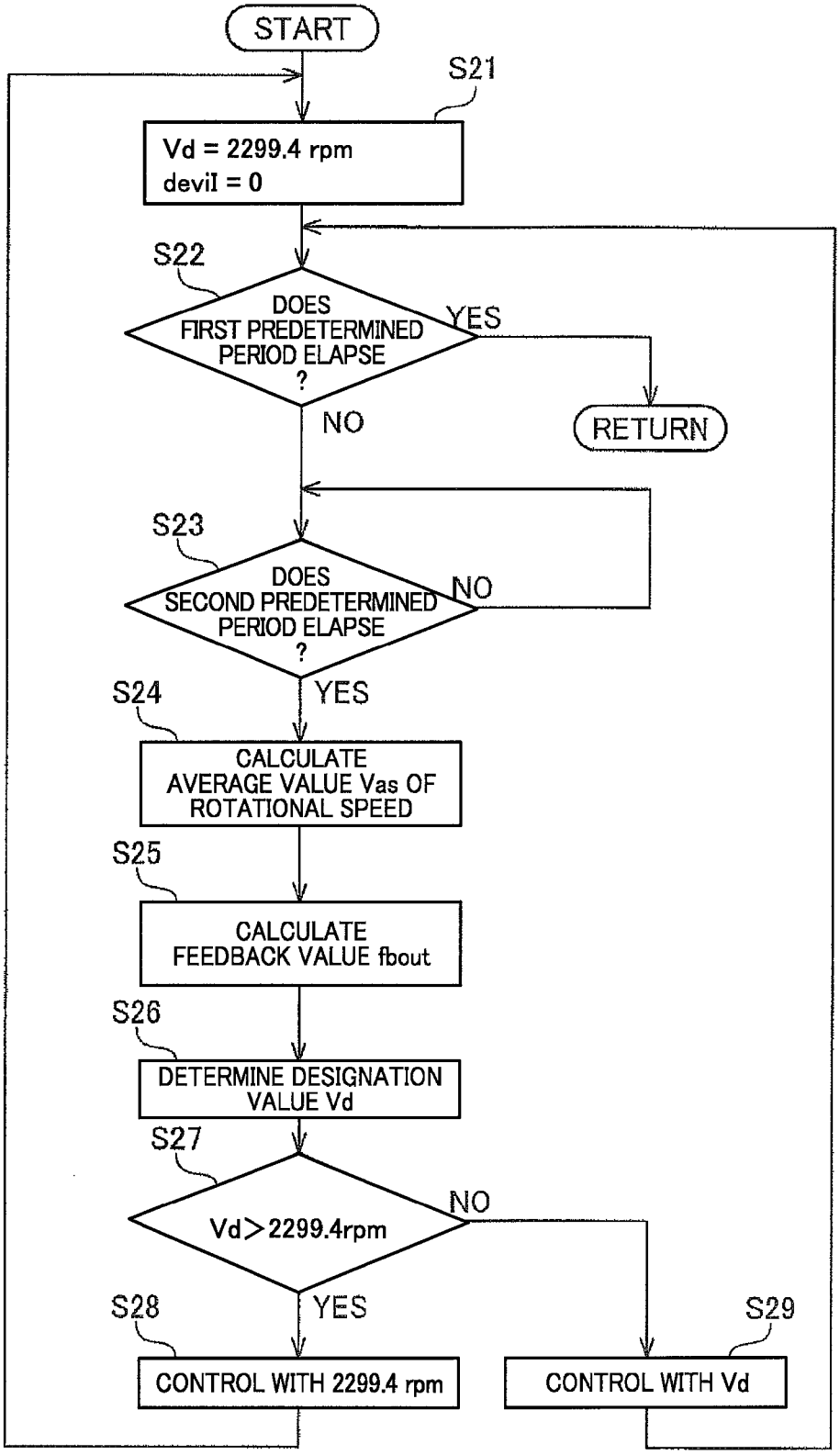
FIG. 7 is a flow chart for showing the speed keeping control process (S8) shown in FIG. 6 in detail.

FIG. 7 is a flow chart for showing the speed keeping control process (S8) shown in FIG. 6 in detail. As shown in FIG. 7, the control unit 100 sets a designation value Vd of the rotational speed of the drive motor M3 to 2299.4 rpm (corresponding to 460 mm/s), and sets a deviation accumulation value deviI to "0" (S21).

The control unit 100 then determines whether or not a first predetermined period elapses (S22). This first predetermined period corresponds to the execution time for performing the speed keeping control and is determined in accordance with the fixing nip width "d" in the slight contact condition in step S5 of FIG. 6. Namely, the first predetermined period is shortened in such a situation that the fixing belt 61 can easily slide over the lower pressure roller 65 with a narrower fixing nip width "d" and thereby the gloss line problem can be resolved quickly. The execution time of the restore control including the speed keeping control can be shortened to prevent the reduction in productivity due to the long-time restore control in such a situation that the fixing belt 61 can easily slide over the lower pressure roller 65 with a narrower fixing nip width "d" and thereby the gloss line problem can be resolved quickly.

If it is determined that the first predetermined period does not elapse (S22: NO), the control unit 100 determines whether or not a second predetermined period (for example, one second) elapses (S23). If it is determined that the second predetermined period does not elapse (S23: NO), this step S23 is repeated until the second predetermined period is determined as elapsing.

On the other hand, if it is determined that the second predetermined period elapses (S23: YES), the control unit 100 continuously reads a speed signal output from the rotational speed detection sensor 69 a predetermined number of times (for example, eight times), and calculates the average value Vas of the rotational speed (S24).

The control unit 100 then calculates a feedback value fbout on the basis of in the following equations (S25).

$$\text{devi}=V\text{ref}-V\text{as}(V\text{as}\geq\text{target } V\text{ref})$$

$$V\text{ref}+V\text{as}(V\text{as}<\text{target } V\text{ref})$$

$$\text{devi}I=\text{devi}I+\text{devi}$$

$$f\text{bout}=A\times\text{devi}+B\times\text{devi}I.$$

In the above equations, A and B are weighting factors which are determined in advance, and Vref is a target value of the rotational speed of the braking force generation motor M1.

Next, the control unit 100 determines the designation value Vd of the rotational speed of the drive motor M3 on the basis of operational expression, Vd=Vd+fbout (S26). The control unit 100 then determines whether or not the designation value Vd exceeds 2299.4 rpm (S27).

If it is determined that the designation value Vd does not exceed 2299.4 rpm (S27: NO), the control unit 100 controls the drive motor M3 (S28) in accordance with the designation value Vd of the rotational speed of the drive motor M3 which is determined in step S26. The process then proceeds to step S22.

Conversely, if it is determined that the designation value Vd exceeds 2299.4 rpm (S27: NO), the control unit 100 sets the designation value Vd to 2299.4 rpm and controls the drive motor M3 (S29) in accordance with this designation value Vd (S29). The process then proceeds to step S21.

Meanwhile, if it is determined that the first predetermined period elapses (S22: YES), the speed keeping process is finished, and the process proceeds to step S9 as shown in FIG. 6.

In step S9, the post process is started. The control unit 100 reduces the rotational speed of the drive motor M3 in this post process (S9). For example, the control unit 100 drives the drive motor M3 to rotate, for example, at 230 mm/s. The control unit 100 then controls the braking torque generation unit 66 to generate no effective braking force (S10).

Next, a prescribed time (for example, two seconds) after reducing the rotational speed of the drive motor M3, the control unit 100 drives the drive motor M4 to rotate the slide cam 82 and release the fixing belt 61 and the lower pressure roller 65 from the slight contact condition by moving the lower pressure roller 65 in the direction opposite to arrow F (S11).

Next, the control unit 100 stops heating with the heat source 60C (S12), and stops the drive motor M3 (S13). The process shown in FIG. 6 is then finished.

Figure 8:
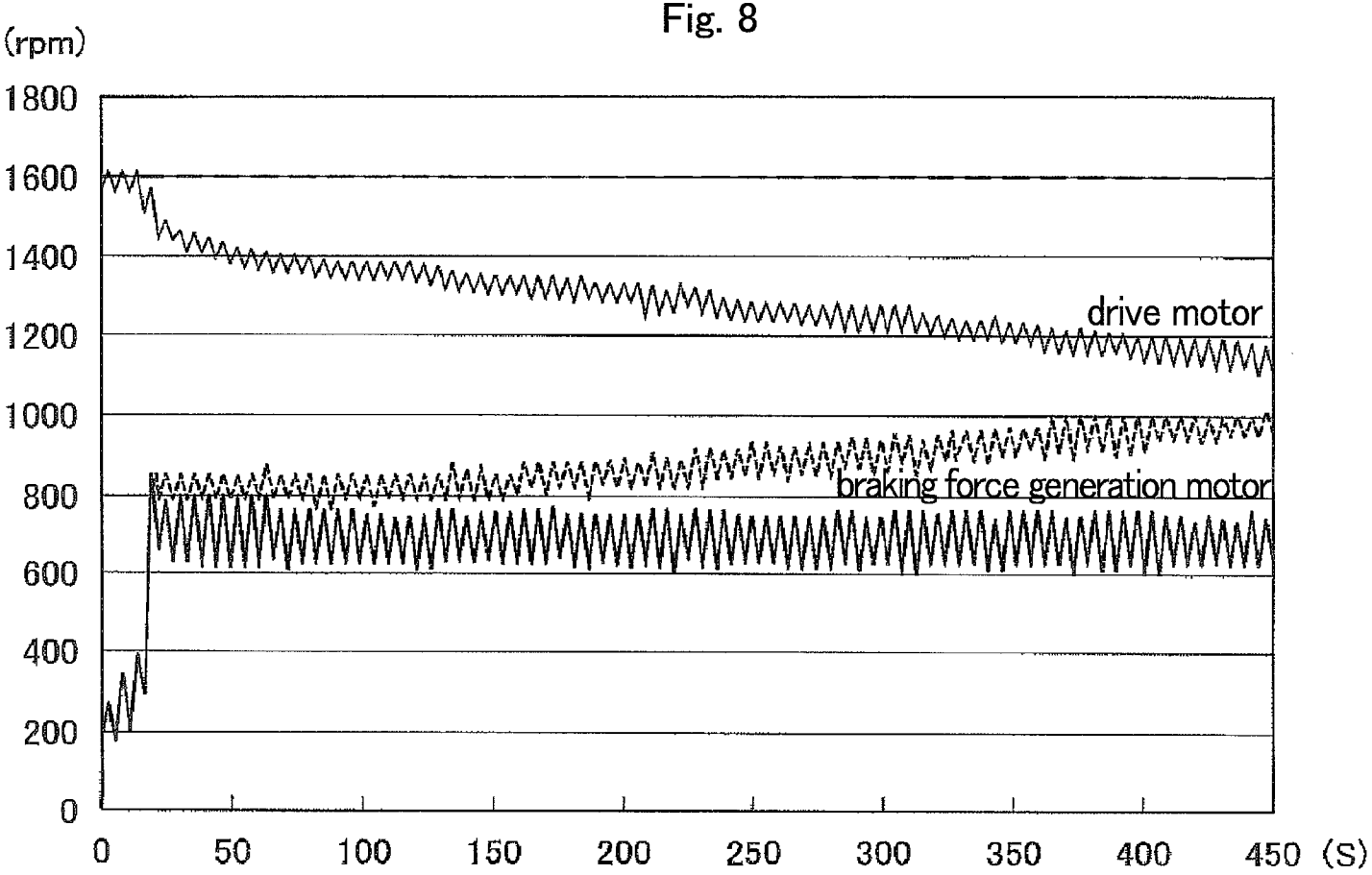
FIG. 8 is a timing chart showing the scheme of controlling the fixing apparatus of the present embodiment.

Next, FIG. 8 is a timing chart showing the scheme of controlling the fixing apparatus of the present embodiment. Incidentally, in FIG. 8, broken line shows an example of rotating the drive motor M3 at a constant speed, and solid line shows an example in accordance with the present embodiment.

Firstly, if the drive motor M3 is driven to rotate at a constant speed, the braking force generation motor M1 is predicted also to rotate at a constant speed. However, since the slipping condition among the upper pressure roller 63, the lower pressure roller 65 and the fixing belt 61 varies in fact, the rotational speed of the braking force generation motor M1 is not constant even if the drive motor M3 is driven to rotate at a constant speed. Particularly, the slipping condition between the upper pressure roller 63 and the fixing belt 61 substantially varies to greatly influence the rotational speed of the braking force generation motor M1.

It is assumed that the drive motor M3 is driven to rotate for example at 1600 rpm as shown in FIG. 8 with broken line. In this case, the rotational speed of the braking force generation motor M1 is about 200 rpm at time 0(s), but spikes to about 800 rpm at time 20(s). After that, the rotational speed of the braking force generation motor M1 gradually increases and reaches about 1000 rpm at time 450(s).

Contrary to this, when the target value Vref is set to 700 rpm in accordance with the present embodiment, feedback control is performed in order that the rotational speed of the braking force generation motor M1 is maintained at 700 rpm. Accordingly, the rotational speed of the braking force generation motor M1 temporarily spikes to about 800 rpm at time 20(s), but thereafter is maintained around 700 rpm through time 450 (s) by feedback control.

Incidentally, since the rotational speed of the braking force generation motor M1 is maintained around 700 rpm as has been discussed above, the rotational speed of the drive motor M3 gradually decreases from time 20(s) to 1400 rpm at time 50(s) and 1200 rpm at time 350(s).

The target value Vref is set to 700 rpm in the above example by considering the following situation relating to the saturation temperatures of the driver circuits of the braking force generation motor M1.

Figure 9:
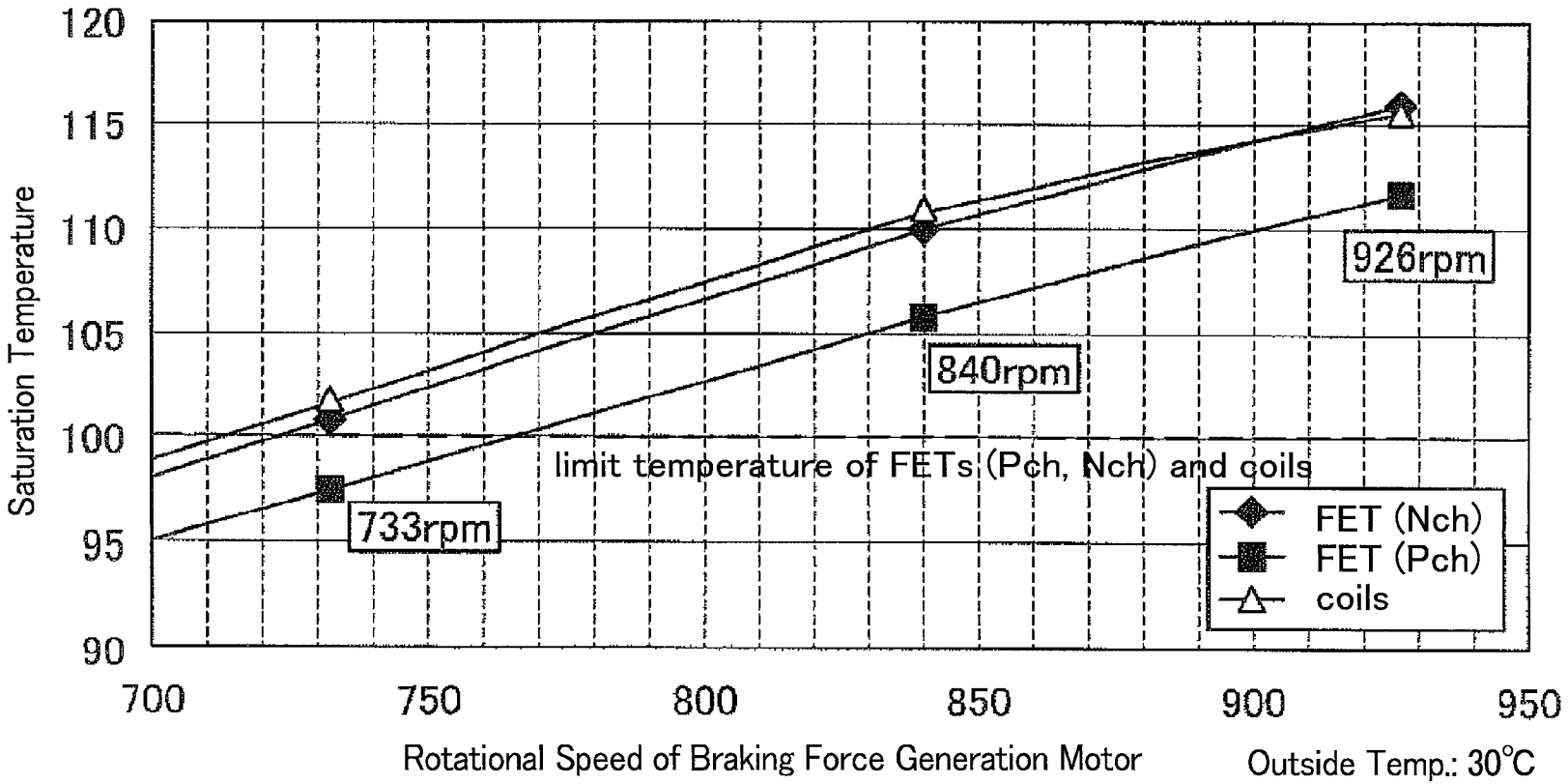
FIG. 9 is a graphic diagram for showing the correlation between the rotational speed of the braking force generation motor and the saturation temperatures of the driver circuits thereof.

FIG. 9 is a graphic diagram for showing the correlation between the rotational speed of the braking force generation motor M1 and the saturation temperatures of the driver circuits thereof. Incidentally, the graph shown in FIG. 9 was based on data measured at an outside air temperature of 30° C.

Although not shown in FIG. 5, the FETs S1*a* to S1*c* include Pch and Nch devices. If it is assumed that the limit temperature of the FETs (Pch, Nch) and coils is 100° C., as shown in FIG. 9, the upper limit rotational speed of the braking force generation motor M1 is about 765 rpm for the Pch FET and 725 rpm for the Nch FET. Also, for the coils, the upper limit rotational speed of the braking force generation motor M1 is about 715 rpm.

Accordingly, the restore control can be continuously performed in an appropriate manner by controlling the braking force generation motor M1 in order not to exceed the upper limit rotational speeds of the driver circuits.

In accordance with the fixing apparatus of the present embodiment, as has been discussed above, since the fixing belt 61 and the lower pressure roller 65 are controlled to rotate while an effective braking force is exerted on the upper pressure roller 63 by the braking force generation motor M1, the fixing belt 61 and the lower pressure roller 65 rotate with a desired differential circumferential speed therebetween to rub the fixing belt 61 and the lower pressure roller 65. Particularly, since the fixing nip width "d" in a non-fixing period is made smaller than the fixing nip width "d" in a fixing period and thereby the fixing belt 61 and the lower pressure roller 65 are apt to slip, it is possible to restore the fixing belt 61 and remove a gloss line by sufficiently rubbing the fixing belt 61 and the lower pressure roller 65 together.

Furthermore, since the rotational speed of the braking force generation motor M1 is kept no higher than a predetermined speed during the restore control, it is possible to inhibit heat generation of the braking force generation motor M1 and continuously perform the restore control for removing a gloss line in an appropriate manner.

Still further, a sheet S is held and conveyed in a fixing period by driving the drive motor M3 and rotating the fixing belt 61 and the lower pressure roller 65 while an effective braking force is exerted on the upper pressure roller 63 by the braking force generation motor M1. The fixing belt 61 can thereby slide over the sheet S in a fixing period to prevent the gloss memory. In addition to this, the gloss memory can be prevented without need for additional mechanical parts to the fixing apparatus which is capable of resolving the gloss line problem and heat generation of the braking force generation motor M1, and therefore cost increase can be suppressed.

Also, since the restore control is performed with the timing that the sheet S conveyed to the fixing nip portion NP is switched to a wider sheet S, it is possible to remove the gloss line in an appropriate manner by performing the restore control with the timing when there is the possibility that a gloss line is formed.

Furthermore, while the fixing nip width "d" in a non-fixing period is decreased to be narrower than in a fixing period, the shorter the fixing nip width "d" in a non-fixing period, the shorter the execution time of the restore control is. Because of this, in such a situation that the fixing belt 61 can easily slide over the lower pressure roller 65 with a narrower fixing nip width "d" and thereby the gloss line problem can be resolved quickly, the execution time of the restore control is shortened to prevent the reduction in productivity due to the long-time restore control.

Also, since the image forming apparatus 1 of the present embodiment includes the image forming unit 40 for forming a toner image on a sheet S and the aforementioned fixing apparatus for fixing the toner image formed by the image forming unit 40 on the sheet S, it is possible to continuously perform the restore control for removing a gloss line in an appropriate manner and output printed sheets with improved image gloss.

The foregoing description has been presented on the basis of the embodiment. However, it is not intended to limit the present invention to the precise form described, and obviously many modifications and variations are possible without departing from the scope of the invention.

For example, in the case of the above embodiment, the fixing apparatus is of a belt nip type. However, the present invention is not limited thereto but can be applied to a roller nip type fixing apparatus.

Also, in the case of the above embodiment, the fixing apparatus is housed in the image forming apparatus 1. However, the present invention is not limited thereto but can be applied even if the fixing apparatus is installed in a finisher or another apparatus.

In addition to this, the configurations, the numerals and the like are not limited to those as described above, but can be changed in any appropriate manner.

Furthermore, while the two motors M1 and M2 are incorporated in the braking torque generation unit 68 in accordance with the above embodiment, the present invention is not limited thereto but a single DC brushless motor may be used for the same purpose. Also, the fixing apparatus of the present embodiment is configured to solve the gloss memory problem by applying an effective braking force on the upper pressure roller 63 even in a fixing period. However, when conveying thin sheets or predetermined thick sheets such as coated cardboard sheets, there is a problem that a sheet S may wrinkle if slipping at the fixing nip portion NP. Because of this, in the case of thin sheets or predetermined thick sheets such as coated cardboard sheets, an assist force is applied to the upper pressure roller 63 to prevent a sheet from wrinkling. It is therefore possible to simplify the structure by making use of a DC brushless motor for constituting the braking torque generation unit 68 such that both the braking force and the assist force can be applied by the single motor.

What is claimed is:

1. A fixing apparatus comprising:

a fixing side member located to face a fixing side of a sheet on which a toner image is formed;

a back side member configured to form a fixing nip portion which holds and conveys the sheet when the back side member is urged against the fixing side member;

a drive motor configured to rotate the back side member;

a fixing nip width adjustment unit configured to adjust a fixing nip width of the fixing nip portion;

a braking force generation motor configured to generate a braking force in a direction to hinder rotation of the fixing side member;

a rotational speed detection unit configured to detect a rotational speed of the braking force generation motor; and a control unit configured to perform restore control for rotating the fixing side member and the back side member with a desired differential circumferential speed therebetween by driving the drive motor while the braking force is exerted on the fixing side member by the braking force generation motor, wherein the control unit performs speed keeping control for keeping the rotational speed of the braking force generation motor detected by the rotational speed detection unit no higher than a predetermined speed while the restore control is being performed, and wherein the control unit performs the restore control and the speed keeping control in a non-fixing period in which the fixing nip width adjustment unit is controlled to decrease the fixing nip width to be smaller than in a fixing period.

2. The fixing apparatus of claim 1, wherein the control unit drives the drive motor in the fixing period to hold and convey a sheet through the fixing nip portion while the braking force is applied to the fixing side member by the braking force generation motor.

3. The fixing apparatus of claim 2, wherein the braking force generation motor is a DC brushless motor.

4. The fixing apparatus of claim 1, wherein the control unit performs the restore control at a timing when the sheet conveyed to the fixing nip portion is switched to a wider sheet.

5. The fixing apparatus of claim 1, wherein while controlling the fixing nip width adjustment unit during the restore control to decrease the fixing nip width in the non-fixing period to be smaller than in the fixing period, the control unit reduces an execution time of the restore control as the fixing nip width in the non-fixing period decreases.

6. An image forming apparatus comprising:

an image forming unit configured to form a toner image on a sheet; and a fixing apparatus as recited in claim 1 to fix the toner image formed on the sheet.

7. A fixing apparatus comprising:

a fixing side member located to face a fixing side of a sheet on which a toner image is formed;

a back side member configured to form a fixing nip portion which holds and conveys the sheet when the back side member is urged against the fixing side member;

a drive motor configured to rotate the back side member;

a fixing nip width adjustment unit configured to adjust a fixing nip width of the fixing nip portion;

a braking force generation motor configured to generate a braking force in a direction to hinder rotation of the fixing side member;

a rotational speed detection unit configured to detect a rotational speed of the braking force generation motor; and a control unit configured to perform restore control for rotating the fixing side member and the back side member by driving the drive motor and to perform speed keeping control for keeping the rotational speed of the braking force generation motor detected by the rotational speed detection unit no higher than a predetermined speed during the restore control, in a non-fixing period in which the fixing nip width adjustment unit is controlled to decrease the fixing nip width to be smaller than in a fixing period and a braking force is applied to the fixing side member by the braking force generation motor, wherein while controlling the fixing nip width adjustment unit during the restore control to decrease the fixing nip width in the non-fixing period to be smaller than in the fixing period, the control unit reduces an execution time of the restore control as the fixing nip width in the non-fixing period decreases.

* * * * *